US005634982A

United States Patent [19]

Jocher

[11] Patent Number: 5,634,982

[45] Date of Patent: Jun. 3, 1997

[54] PROCESS FOR DECONTAMINATING SURFACES OF NUCLEAR AND FISSILE MATERIALS

[75] Inventor: William F. Jocher, Dayton, Tenn.

[73] Assignee: Corpex Technologies, Inc., Morrisville, N.C.

[21] Appl. No.: 602,908

[22] Filed: Feb. 16, 1996

[51] Int. Cl.[6] ..... B08B 3/08; B08B 9/00

[52] U.S. Cl. ..... 134/7; 134/8; 423/283; 376/310; 970/DIG. 376; 588/1; 51/307

[58] Field of Search ..... 588/1; 451/39; 976/DIG. 376; 376/310; 134/6, 8, 7, 21.11; 423/276, 277, 283; 51/307

[56] References Cited

U.S. PATENT DOCUMENTS

| | | | |
|---|---|---|---|
| 3,778,938 | 12/1973 | Korn et al. | 51/320 |
| 3,894,364 | 7/1975 | Korn et al. | 51/320 |
| 3,895,465 | 7/1975 | Korn et al. | 51/320 |
| 3,937,522 | 2/1976 | Korn et al. | 302/56 |
| 4,182,652 | 1/1980 | Puechl | 176/50 |
| 4,193,853 | 3/1980 | Childs et al. | 204/129.95 |
| 4,196,177 | 4/1980 | Sallay | 423/279 |
| 4,397,778 | 8/1983 | Lloyd | 252/627 |
| 4,533,481 | 8/1985 | Jahnke | 252/496 |
| 4,609,757 | 9/1986 | D'Muhala et al. | 564/151 |
| 4,633,623 | 1/1987 | Spitz | 51/439 |
| 4,726,907 | 2/1988 | D'Muhala et al. | 252/82 |
| 4,756,770 | 7/1988 | Weems et al. | 134/37 |
| 4,775,491 | 10/1988 | D'Muhala et al. | 252/180 |
| 4,871,478 | 10/1989 | Petrich et al. | 252/627 |
| 5,046,289 | 9/1991 | Bengel et al. | 51/411 |
| 5,092,923 | 3/1992 | Dillard et al. | 106/14.05 |
| 5,146,716 | 9/1992 | Lynn | 51/320 |
| 5,234,470 | 8/1993 | Lynn et al. | 51/293 |
| 5,256,703 | 10/1993 | Hermann et al. | 521/120 |
| 5,325,638 | 7/1994 | Lynn | 51/320 |
| 5,405,648 | 4/1995 | Hermann | 427/213.31 |

*Primary Examiner*—Ngoclan Mai
*Attorney, Agent, or Firm*—Bell, Seltzer, Park & Gibson

[57] ABSTRACT

The present invention provides a process for decontaminating a surface of nuclear or fissile materials or both. The process includes impacting ortho-boric acid crystals onto the surface. The present invention also provides an abrasive media comprising ortho-boric acid crystals having a boron-10 content of at least 19 percent by weight.

16 Claims, No Drawings

PROCESS FOR DECONTAMINATING SURFACES OF NUCLEAR AND FISSILE MATERIALS

FIELD OF THE INVENTION

The present invention relates to a process for decontaminating various surfaces of nuclear and fissile materials, particularly surfaces associated with nuclear power plants or with closed weapons facilities.

BACKGROUND OF THE INVENTION

In the nuclear industry, metal surfaces of various equipment becomes contaminated with radioactive nuclear materials. Exemplary equipment includes piping, valves, gloveboxes, pumps, ventilation, ductwork, machinery and other structural members. The contamination may be fissile nuclear material, uranium plutonium, americium and the like. Specifically, the decontamination of nuclear power plants and weapons facilities of such fissile materials is a difficult problem. There is a tremendous need for improvement in this area, wherein the improvement must combine and meet safety, disposability and cost-effectiveness requirements and minimum halogen impurity levels. Much of the decontamination is highly enriched fissile material particularly uranium-235.

Highly enriched fissile material reacts with neutrons in thermal equilibrium with target nuclei to produce a chain reaction. The chain reaction is sometimes referred to as "criticality". Criticality is achieved when the number of fissioning neutrons equals the number of neutrons leaked out of the geometry and the number of neutrons that undergoes resonant absorbance. During clean-up of equipment, particularly at a weapons facility, great care must be taken to avoid creating conditions which could potentially support achieving criticality.

Conventional techniques for decontaminating other materials including non-fissile radioactive materials often utilize blasting such blasting techniques. See, for example, U.S. Pat. No. 3,895,465 to Korn et al., and U.S. Pat. No. 5,046,289 to Benzel et al. These techniques, however, do not take into account the avoidance of criticality and minimum halogen content material compatibility issues. The inventors are unaware of the use of these known techniques in decontaminating surfaces of fissile or radioactive materials. In fact, many of the techniques may have the potential to enhance the likelihood of achieving criticality, and halogen induced stress cracking corrosion, a very undesirable result.

Thus, there is a need for a media and process for decontaminating surfaces of nuclear and fissile materials that precludes any potential of criticality resulting from fissioning of neutrons and the formation of critical geometry, and also addresses safety disposability, corrosion, and excess radwaste issues.

SUMMARY OF THE INVENTION

It is therefore an object of the present invention to overcome the aforementioned problems of known decontamination processes.

It is another object of the present invention to provide a process of decontamination and media that substantially reduces the likelihood of criticality of the fissile materials.

It is another object of the present invention to provide a process and media that will meet nuclear steam system supplier ("NSSS") minimum halogen requirements for contacting stainless steel, or mixing with steam generator or reactor feedstock.

It is still another object of the present invention to provide a process of decontamination which generates substantially less solid and liquid radwaste.

These and other objects, features and advantages are provided by the processes and media of the present invention. In one embodiment, the process comprises contacting ortho-boric acid crystals or a chelant solution of ortho-boric acid crystals with a surface (e.g., stainless steel) contaminated with nuclear or fissile materials or both. In another embodiment, the contacting can include impacting the boric acid crystals against the surface at sufficient rate such that the ortho-boric acid crystals abrade the surface and remove the nuclear or fissile materials or both. The processes of the present invention are particularly applicable to the decontamination of metal surfaces contaminated with corrosion products and fissile materials such as uranium, plutonium, americium and the like. The boric acid in the appropriate physical form will not only remove the nuclear or fissile material but also substantially reduce the risks associated with the danger of achieving criticality and any likelihood of halogen induced stress cracking corrosion.

DETAILED DESCRIPTION OF THE INVENTION

The present invention will now be described more fully hereinafter. The invention may, however, be embodied in many different forms and should not be construed as limited to the embodiment set forth herein; rather, this embodiment is provided so that this disclosure will be thorough and complete, and will fully convey the scope of the invention to those skilled in the art.

As summarized above, the process of the invention comprises contacting a surface with ortho-boric acid crystals to decontaminate the surface of nuclear or fissile materials or both. In another embodiment, the process comprises contacting a solution of boric acid crystals and a chelant. The contacting typically occurs at ambient temperature when using the crystals to abrade the surface or at a temperature of about 20° C. to 100° C. when a solution is used. Exemplary surfaces include but are not limited to the various metal (e.g., stainless steel) surfaces of the nuclear industry that become contaminated. These surfaces are components of equipment such as piping, valves, gloveboxes, pumps, ventilation, ductwork, machinery, heat exchangers, reactor heads, fuel rod cavity, reactor cavity and other structural members. These surfaces become contaminated with nuclear or fissile materials such as uranium, plutonium, americium, neptunium, fission products, and reactor corrosion products, often in the form of oxides.

An example of the applicability of the processes and media of the present invention wherein halogen induced stress cracking corrosion is a concern in the cleanup of a nuclear reactor power plant. Such power plants impose strict levels of halogen impurities in media that may contact stainless steel or leak into in media that may contact stainless steel or leak into steam generator or reactor coolant feedstock.

A nuclear reactor power plant produces heat which is transferred to a liquid moderator. The moderator circulates through at least one heat exchanger or steam generator to produce steam. The steam produced in the steam generator is then transferred to a turbine-generator for generating electricity. The circulating liquid moderator, however, typically has dissolved and suspended radioactive nuclear material therein. This highly radioactive nuclear material usually is radioactive corrosion products formed from within the reactor, the plant piping system and the plant equipment through which the moderator circulates. During operation of the nuclear reactor, these radioactive corrosion products may form a sediment which will deposit on the inside surfaces of the plant piping system and plant equipment. In order to safely perform some types of maintenance on the nuclear reactor power plant such as removing the steam generator, these highly radioactive deposits should be removed.

Typically during removal, one end of the piping is exposed because it has been severed, and the other end of the piping remains connected to plant equipment. In any case, after the steam generator is removed, the radiation field emitting though the exposed pipe stubs, due to the radioactive corrosion products on the inside surface of the piping, may expose maintenance workers to an undesirable level of radiation.

Moreover, the steam generator itself must be cleaned. Generally the steam generator comprises an upright pressure vessel having disposed therewithin a plurality of heat exchange tubes which extend longitudinally through the interior of the apparatus and which are braced and supported at vertically spaced apart intervals by a plurality of suitable tube bundle support plates. The heat exchange tubes are confined within a generally cylindrical shroud concentrically disposed within the generator, and the space between the shroud and the outer casing is divided into an upper steam annulus and a lower downcomer annulus. A first heat exchange passageway to the system is defined through a primary coolant inlet nozzle which thermally communicates with a plurality of elongated, longitudinally extending heat exchange tubes, and terminates is suitable outlet channel for transmission of the primary coolant back to the reactor. Such steam generators are disclosed in more detail in U.S. Pat. Nos. 4,158,387 and 4,068,627, the disclosures of which are incorporated in their entirely by reference.

The use of such generators results in the accumulation of certain undesirable radioactive nuclear material which are deposited within the heat exchange apparatus, primarily upon the tube sheets, tubes and their tube support structures.

Another example of the applicability of the processes and media of the present invention is its use in the cleanup of weapons facilities. In a weapons facility a gaseous diffusion enrichment is used to produce weapons grade fissile material. The gaseous diffusion process is based on different diffusion of the isotopic constituents in $UF_6$ gas. All molecules have the same average kinetic energy. The lighter uranium-235 hexaflouride molecules have a slightly greater speed when contrasted with commingled uranium-238 isotopes which have a slightly heavier mass. When both isotopes are forced against a porous membrane of controlled porosity the faster uranium-235 penetrates preferentially into the membrane. Weapons facilities producing bomb grade material will have some three thousand stages which include a compressor, valves, a motor and a convertor. Uranium hexaflouride can also be processed by centrifuge. The heavier 238 molecules are preferentially driven to the outside perifia of the centrifuge; the lighter 235 molecules gravitate toward the center axis. Feed gas enters along the center axis and migrates downward and it eventually establishes a longitudinal countercurrent flow pattern in the high speed rotor section of the centrifuge to sustain the process.

Left in a shutdown condition moisture will react with the hexaflouride and convert it to its respective oxide form. Therefore either vessel can potentially accumulate an oxidized layer rich in fissile material of varying concentration from 4 to 99 percent. Anything in excess of 4 percent uranium-235 may present criticality problems that must be addressed and overcome prior to initiating decontamination. Boric acid crystals enriched in boron-10 and used as an abrasive media or in a solution with a chelant will successfully prelude aggregation of the 235 isotope into a critical geometry. By absorbing neutrons from spontaneously fissioning 235 in the boron-10 isotope no criticality can occur. Decontamination efforts can then be safely started.

There are several ways the surface to be decontaminated can Le contacted with the ortho-boric acid crystals. In a preferred embodiment, the contacting is accomplished by impacting the ortho-boric acid crystals against the surface at substantially high rate, i.e., about 200 to 800 g/100 $cm^2$/min., and preferably 400 to 600 g/100 $cm^2$/min. One skilled in the art will be readily aware of various blasting equipment which can be used to propel the ortho-boric acid crystals against the surfaces.

Preferably, the ortho-boric acid crystals are nuclear grade for power plants or technical grade boric acid crystals for weapons facilities available from U.S. Borax, Wilmington, Calif. having the following specification and specification numbers:

| $H_3BO_3$ SQ Product Spec W-0340 (Nuclear Grade) | GUARANTEE |
|---|---|
| $B_2O_3$% | 56.2–59.1 |
| Equivalent $B_2O_3$% | 99.0–105.0 |
| $SO_4$ ppm | ≦3.0 |
| Cl ppm | ≦0.4 |
| Fe ppm | ≦2.0 |
| Sieve Specification U.S Standard Sieve No. | % Retained Guarantee |
| 8 | ≦0.1 |
| $H_3BO_3$ Product spec B-0310-U (Technical Grade) | GUARANTEE |
| $B_2O_3$% | 56.3–56.8 |
| Equivalent $B_2O_3$% | 99.9–100.9 |
| $SO_4$ ppm | ≦150 |
| Cl ppm | ≦28 |
| Fe ppm | ≦6 |
| Sieve Specification U.S. Standard Sieve No. | % Retained Guarantee |
| 20 | ≦2.0 |

The ortho-boric acid crystals (abrasive media) should have a boron-10 content of at least 19 percent by weight to insure that, the boron acid crystals will act as a neutron poison. Additionally, recycled or recovered boric acid crystals (i.e., depleted of the boron-10 isotope) should be avoided due to the risk of criticality being achieved. Additionally, low halogen content, namely less than 1000 ppm of Cl and the like, and meeting NSSS standards is desirable to avoid contaminating steam generator or reactor feedstock problems associated with corrosion of metal surfaces, particularly, stainless steel.

The boric acid crystals can be used in a homogeneous solution using a chelant, and applied as a liquid particularly when low levels or non-fissile materials are being removed. Preferably the boron solids concentration is at least 4 percent, and preferably from 4 to 30 percent by weight. Suitable chelants include polyaminocarboxylic acids which is ethylenediaminetetraacetic acid (EDTA), diethylenetriaminepetaacetic acid, triethylene-tetraaminehexaacetic acid, N-2-hydroxyethylene-diaminetriacetic acid, propylene-1,2-diaminetetraacetic acid, propylene-1,2-diaminetetraacetic acid, nitrilotriacetic acid, the ammonium and alkali metal salts of the acids, and mixtures thereof. The alkali metal and ammonium salts can include mono- and disubstituted salts.

Another suitable class of chelants are hydrazide compounds, an alkali metal or ammonium salt of the hydrazide, or mixtures thereof. Hydrazides which may be employed are numerous and include those described, for example, in U.S. Pat. Nos. 4,609,757 and 4,726,907 to D'Muhala et al.; and U.S. Pat. No. 4,708,805 to D'Muhala, the disclosures of which are incorporated by reference in their entirety. Typically, the hydrazides are derived from known reactions which typically involve amino polycarboxylic acids such as, for example, an amino polyacetic acid. Specifically, tetrahydrazide formed from EDTA may be employed. Other hydrazides which may be used include carboxyhydrazides, i.e., polycarbazic acids. Exemplary polycarbazic acids are of the general formula:

$$(R)_2—N—[CH_2CH_2N(R]_m—R$$

wherein R is the group $CH_2$—CO—NH—NH—COOH and m is 0 or an integer from 1 to 4. Preferably, m is 0 or 1. Another suitable polycarbazic acid includes that described by the general formula:

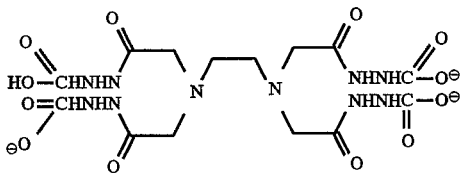

Other additives may include surfactants, dispersants, corrosion inhibitors, and acid neutralizing agents. In the solution, the concentration of boric acid should be from 4 to 30 percent by weight.

The boric acid crystals may be used in combination with another abrasive blast media such as described in U.S. Pat. No. 5,234,470 to Lynn or U.S. Pat. No. 5,256,703 to Herrmann et al., the disclosures of which are incorporated herein in their entirety by reference. An abrasive media is placed in a saturated solution of ortho-boric acid and allowed to cool. Once ambient temperature is reached, the boric acid will crystallize and encapsulate the media. Preferably this media is then crushed and used as blast media as described previously.

The boric acid crystals after contacting the surface will easily go into solution and can be added back to the refueling water or can be co-mingled with other waste that is discharged into the normal waste stream. Moreover, the media can be filtered using the plant's demineralizing system. Thus, there is substantially less radwaste as compared to typical media.

The foregoing is illustrative of the present invention and is not to be construed as limiting thereof. The invention is defined by the following claims, with equivalents of the claims to be included therein.

That which is claimed is:

1. A process for decontaminating a surface of nuclear or fissile materials or both comprising impacting ortho-boric acid crystals onto the surface.

2. The process according to claim 1 wherein the boric acid crystals have a boron content of at least about 19 percent by weight.

3. The process according to claim 1 wherein the boric acid crystals are in solution with a chelant.

4. The process according to claim 1 wherein the boric acid crystals are in solution with a hydrazide.

5. The process according to claim 1 wherein the boric acid crystals are impacted onto the surface at a rate of 200 to 800 g/100 $cm^2$/min.

6. The process according to claim 1 wherein the process is carried out at about ambient temperature.

7. The process according to claim 1 wherein the boric acid crystals have a halogen content of less than 1000 ppm.

8. A process for decontamination a surface of nuclear or fissile materials or both comprising contacting the surface with a solution containing ortho-boric acid crystals having a boron solids concentration of at least 4 percent by weight and a boron-10 content of at least 19 percent by weight.

9. The process according to claim 8 wherein the solution includes a chelant.

10. The process according to claim 8 wherein the solution includes a hydrazide.

11. The process according to claim 8 wherein the boric acid crystals are impacted onto the surface at a rate of 200 to 800 g/100 $cm^2$/min.

12. The process according to claim 8 wherein the process is carried out a temperature of about 20° to 100° C.

13. The process according to claim 8 wherein the boric acid crystals have a halogen content of less than 1000 ppm.

14. An abrasive media suitable for the decontamination of surfaces contaminated with nuclear or fissile materials or both, the media comprising ortho-boric acid crystals having a boron-10 content of at least 19 percent by weight.

15. A solution suitable for the decontamination of surfaces contaminated with nuclear or fissile materials or both, the solution comprising ortho-boric acid crystals having a boron-10 content of at least 19 percent by weight, and a chelant.

16. The solution according to claim 15 wherein the chelant is a hydrazide.

* * * * *